US009636915B2

(12) United States Patent
Tanaka

(10) Patent No.: US 9,636,915 B2
(45) Date of Patent: May 2, 2017

(54) PRINTING DEVICE, AND CONTROL METHOD OF A PRINTING DEVICE

(71) Applicant: Seiko Epson Corporation, Tokyo (JP)

(72) Inventor: Atsushi Tanaka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/021,613

(22) PCT Filed: Oct. 28, 2014

(86) PCT No.: PCT/JP2014/005455
§ 371 (c)(1),
(2) Date: Mar. 11, 2016

(87) PCT Pub. No.: WO2015/064092
PCT Pub. Date: May 7, 2015

(65) Prior Publication Data

US 2016/0221342 A1 Aug. 4, 2016

(30) Foreign Application Priority Data

Oct. 30, 2013 (JP) ..... 2013-225053

(51) Int. Cl.
*B41J 2/165* (2006.01)

(52) U.S. Cl.
CPC ..... *B41J 2/1652* (2013.01); *B41J 2/16508* (2013.01); *B41J 2/16511* (2013.01); *B41J 2/16535* (2013.01); *B41J 2/16538* (2013.01); *B41J 2/16544* (2013.01); *B41J 2/16579* (2013.01); *B41J 2002/1657* (2013.01); *B41J 2002/16573* (2013.01)

(58) Field of Classification Search
CPC .. B41J 2/1652; B41J 2/16535; B41J 2/16579; B41J 2/16544; B41J 2/16511; B41J 2/16538; B41J 2/16508; B41J 2002/1657; B41J 2002/16573
See application file for complete search history.

(56) References Cited

U.S. PATENT DOCUMENTS

| | | | | |
|---|---|---|---|---|
| 6,402,289 | B2 | 6/2002 | Nitta | |
| 2004/0246294 | A1* | 12/2004 | Mitsuzawa | B41J 2/145 347/23 |
| 2012/0268522 | A1 | 10/2012 | Hatao | |

FOREIGN PATENT DOCUMENTS

| | | | |
|---|---|---|---|
| CN | 102744966 | A | 10/2012 |
| JP | 09-187953 | A | 7/1997 |
| JP | 2009-269291 | A | 11/2009 |

(Continued)

OTHER PUBLICATIONS

International Search Report for Application No. PCT/JP2014/005455, mailed Feb. 3, 2015 (5 pages).

*Primary Examiner* — Geoffrey Mruk
(74) *Attorney, Agent, or Firm* — Nutter McClennen & Fish LLP; John J. Penny, Jr.

(57) ABSTRACT

The time required for cleaning an inkjet head is shortened. A printing device can clean an inkjet head by a first cleaning method that simultaneously suctions ink from the plural heads H of the inkjet head, or a second cleaning method that suctions ink from plural heads H of the inkjet head one by one, and the control unit sets the method of cleaning the inkjet head to either the first cleaning method or the second cleaning method.

8 Claims, 8 Drawing Sheets

(56) References Cited

FOREIGN PATENT DOCUMENTS

| | | | |
|---|---|---|---|
| JP | 2010-012625 | A | 1/2010 |
| JP | 2010-105297 | A | 5/2010 |
| JP | 2012-086369 | A | 5/2012 |
| JP | 2012-091526 | A | 5/2012 |
| JP | 2013-028134 | A | 2/2013 |

* cited by examiner

PRINTING DEVICE, AND CONTROL METHOD OF A PRINTING DEVICE

Priority is claimed under 35 U.S.C. §119 to Japanese Application No. 2013-0225053 filed on Oct. 30, 2013 and under 35 U.S.C. §365 to PCT/JP2014/005455 filed on Oct. 28, 2014.

TECHNICAL FIELD

The present invention relates to a printing device with an inkjet head, and to a control method of the printing device.

BACKGROUND

Printing devices that have an inkjet head and eject ink from the inkjet head to print images on print media are known from the literature (see, for example, PTL 1.)

Printers that print with an inkjet head are usually built so that they can clean the printhead. Cleaning is a process of suctioning ink clogging the inside of the nozzles of the inkjet head.

CITATION LIST

Patent Literature

[PTL 1] JP-A-2010-12625

SUMMARY OF INVENTION

The printing device cannot print images on the print medium during the cleaning process. Shortening the time required for cleaning is therefore desirable.

The invention is directed to solving the foregoing problem, and an objective of the invention is to provide a printing device and a control method of a printing device that can shorten the time required for cleaning.

To achieve the above objective, a printing device according to the invention has an inkjet head having plural heads with a nozzle row; is configured to clean the inkjet head by either a first cleaning method that simultaneously suctions ink from the plural heads of the inkjet head, or a second cleaning method that separately suctions ink from plural heads of the inkjet head; and has a control unit that selects either the first cleaning method or the second cleaning method as the method of cleaning the inkjet head, the control unit characterized by detecting if there are missing nozzles in the heads, and selecting whichever of the first cleaning method and the second cleaning method requires less time for cleaning as the cleaning method when cleaning the inkjet head.

Thus comprised, cleaning can be done by whichever of the first cleaning method and second cleaning method requires less time. Therefore, the cleaning method can also be changed according to the condition of the heads to the method that requires less time for cleaning, and the time required for cleaning can therefore be shortened. Furthermore, because the time required for cleaning with the second cleaning method differs according to the number of heads in which missing nozzles are detected, the method of cleaning can be set to the method that requires less time for cleaning.

In a printing device according to another aspect of the invention, ink is suctioned one by one from the heads in which a missing nozzle was detected when cleaning with the second cleaning method.

In a printing device according to another aspect of the invention, to clean the inkjet head, the control unit selects the cleaning method that requires less time for cleaning including wiping after suctioning ink.

Thus comprised, the method of cleaning can be changed to reflect the time required for wiping so that the time required for cleaning is shorter.

In a printing device according to another aspect of the invention, the heads are wiped sequentially after simultaneously suctioning ink from all heads in the inkjet head in the first cleaning method; the heads targeted for ink suction are suctioned and then wiped one by one in the second cleaning method; and to clean the inkjet head, the control unit selects the cleaning method that requires less time for cleaning including wiping after suctioning ink.

Thus comprised, the method of cleaning can be changed to reflect the time required for wiping so that the time required for cleaning is shorter.

To achieve the foregoing objective, another aspect of the invention is a control method of a printing device having an inkjet head including plural heads with a nozzle row, and configured to clean the inkjet head by either a first cleaning method that simultaneously suctions ink from the plural heads of the inkjet head, or a second cleaning method that separately suctions ink from plural heads of the inkjet head, the control method including determining whether cleaning by the first cleaning method or cleaning by the second cleaning method requires less time; and changing the method of cleaning the inkjet head to the method that requires less cleaning time.

This control method can change the method of cleaning to the method requiring less time for cleaning, and can shorten the time required for cleaning.

The invention enables cleaning by a first cleaning method or a second cleaning method in a printing device having an inkjet head comprising multiple heads with a row of nozzles. Therefore, the cleaning method can be changed according to the condition of the heads to the method that requires less time for cleaning, and the time required for cleaning can be shortened.

DETAILED DESCRIPTION

A preferred embodiment of the present invention is described below with reference to the accompanying figures.

Figure 1:
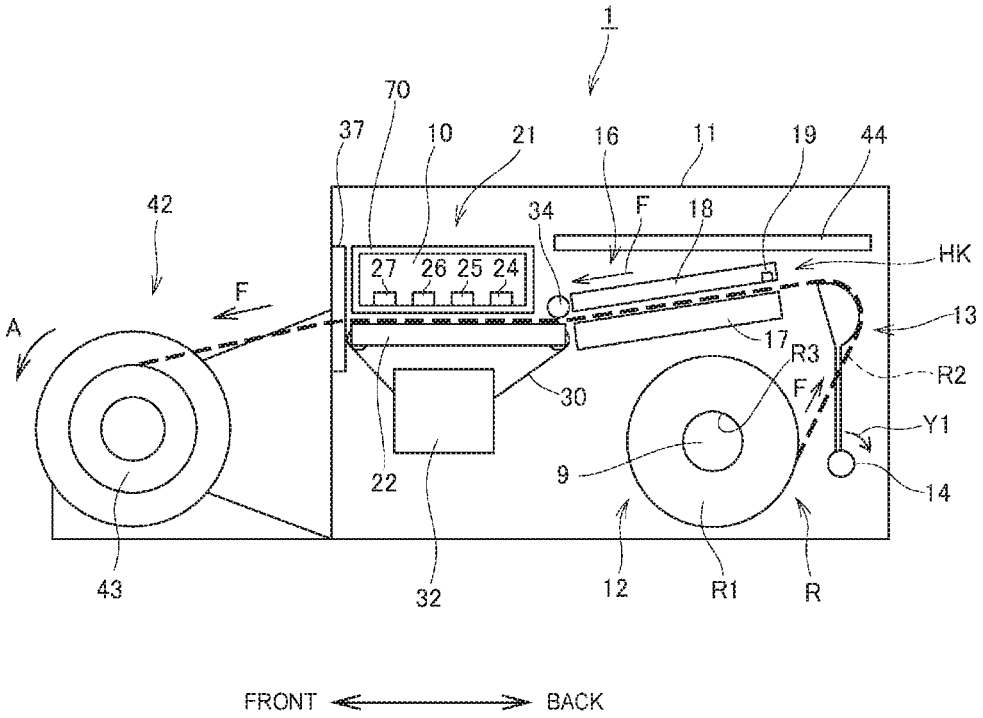
FIG. 1 is a side view of a printing device according to the invention.
Figure 2:
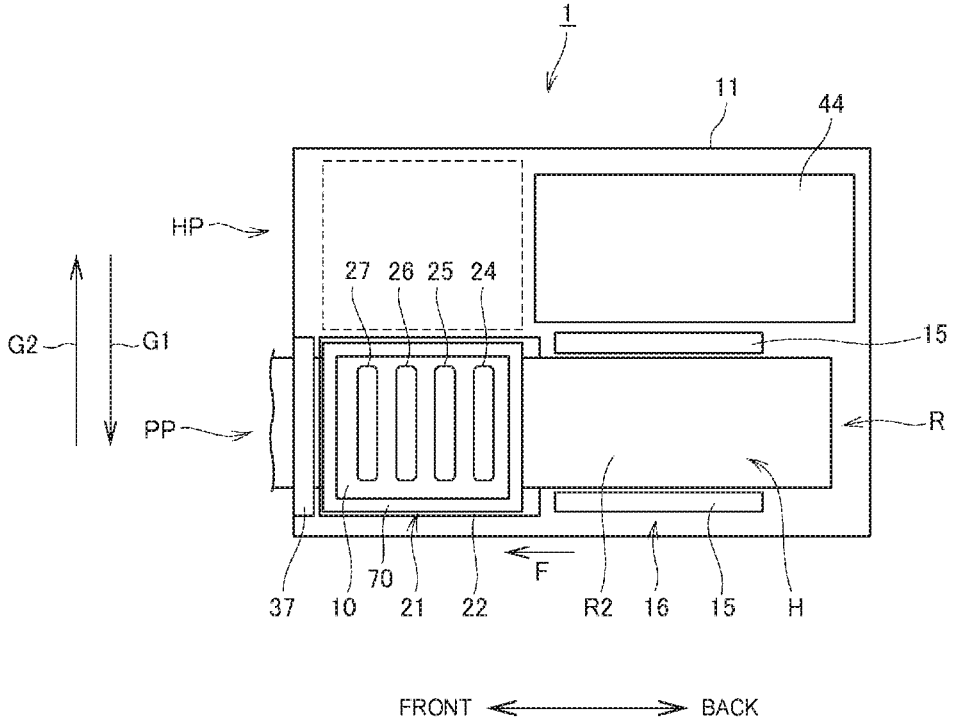
FIG. 2 is a top view of the printing device.

FIG. 1 is a side view schematically illustrating the internal configuration of a printing device 1 according to this embodiment of the invention. FIG. 2 is a top view schematically illustrating the internal configuration of the printing device 1.

The printing device 1 is an inkjet line printer that prints images on print media by ejecting ink from an inkjet head 10 configured as an inkjet line head while conveying the print medium through the conveyance path HK.

In the following description of the printer using FIG. 1 and FIG. 2, the longitudinal axis between the front and back of the printer is indicated by the arrows in the figures.

As shown in FIG. 1, the printing device 1 has a printer case 11, and a roll paper storage unit 12 is disposed in the back of the printer case 11.

The roll paper storage unit 12 is where the roll paper R is stored. The paper roll R is a continuous sheet medium wound into a roll, and may be plain paper or fine paper wound into a roll, or label paper having labels of a regular size and an adhesive backing affixed to a release liner (web) and wound into a roll.

Below, the portion of the paper roll R that forms a roll with a hollow center is referred to as the paper roll R1, and the paper that is pulled from the paper roll R1 and conveyed through the conveyance path HK is referred to as the conveyed roll paper R2. The conveyed roll paper R2 is indicated in FIG. 1 by a dotted line.

The paper roll R1 is stored in the roll paper storage unit 12. At this time, a roll paper spindle 9 is inserted to the hollow core R3 in the center of the paper roll R1. The roll paper spindle 9 is connected through a speed reducer mechanism not shown to the drive shaft of the conveyance motor 64 described below, and turns as driven by the spindle rotation motor 64. The paper roll R1 turns in conjunction with rotation of the roll paper spindle 9 fit into the core R3 of the paper roll R1.

The conveyed roll paper R2 is pulled from the paper roll R1 in the roll paper storage unit 12 upward and then forward in the conveyance direction F. A tension lever 13 is disposed above and behind the axis of the paper roll R1. The conveyed roll paper R2 pulled upward contacts the tension lever 13, curves around the tension lever 13, and then continues to the front.

The tension lever 13 applies tension to the conveyed roll paper R2 and prevents slack. The tension lever 13 is urged to pivot on a pin 14 in the direction applying tension to the conveyed roll paper R2 (the direction indicated by arrow Y1).

A paper guide 16 is disposed in front of the tension lever 13. The paper guide 16 includes a lower paper guide 17 (FIG. 1), upper paper guide 18 (FIG. 1), and side paper guide 15 (FIG. 2). The lower paper guide 17 is a platform that supports the conveyed roll paper R2 from below. The upper paper guide 18 is positioned opposite the lower paper guide 17 with the conveyed roll paper R2 therebetween, and prevents the conveyed roll paper R2 from lifting away from the lower paper guide 17. The side paper guide 15 guides the sides of the conveyed roll paper R2 in the conveyance direction F, and suppresses skewing and shifting of the conveyed roll paper R2.

A paper detector 19 (FIG. 1) is disposed at the back end of the paper guide 16. The paper detector 19 is, for example, a transmissive light sensor including an emitter on the upper paper guide 18 side and a receptor on the lower paper guide 17 side. The output value (detection voltage) indicating the amount of light received by the photoreceptor of the paper detector 19 differs according to whether or not the conveyed roll paper R2 is at the detection position of the paper detector 19, and the paper detector 19 can therefore be used to detect the leading end and the trailing end of the conveyed roll paper R2.

A print unit 21 that prints images on the conveyed roll paper R2 is disposed in front of the paper guide 16. The print unit 21 includes a platen 22 and the inkjet head 10.

The inkjet head 10 in this embodiment ejects four colors of ink, C (cyan), M (magenta), Y (yellow), K (black), and forms dots on the printing surface of the conveyed roll paper R2. The inkjet head 10 includes a black head unit 24 that ejects black ink, a cyan head unit 25 that ejects cyan ink, a magenta head unit 26 that ejects magenta ink, and a yellow head unit 27 that ejects yellow ink.

The platen 22 has a flat surface along the conveyance direction F. This flat surface is opposite the inkjet head 10. The platen 22 is fixed to the frame (not shown in the figure) of the printing device 1, and supports the conveyed roll paper R2 from below. The surface of the platen 22 is substantially horizontal when the printing device 1 is set up for use.

A conveyor belt 30 (FIG. 1) is disposed over the surface of the platen 22. The conveyor belt 30 is a wide, endless belt that travels over the top of the platen 22 and then loops below the platen 22. At least the surface of the conveyor belt 30 that faces up when the conveyor belt 30 travels over the top of the platen 22 is a rough surface with a high coefficient of friction. The conveyor belt 30 is further preferably made of a rubber or plastic elastic material. A conveyance unit 32 including a conveyance motor 31 (FIG. 5) and a drive mechanism that moves the conveyor belt 30 by means of the torque from the conveyance motor 31 is disposed below the platen 22. The conveyance motor 31 turns as controlled by the printer control unit 50 described below. The drive mechanism not shown of this conveyance unit 32 includes a gear that engages the output shaft of the conveyance motor 31, and a roller that moves the conveyor belt 30. The conveyor belt 30 moves according to rotation of the conveyance motor 31, and conveys the conveyed roll paper R2 in the conveyance direction F. The conveyance direction and the conveyance speed of the print medium accompanying movement of the conveyor belt 30 are detected using a rotary encoder 60 (FIG. 5) described further below.

A conveyance roller 34 (FIG. 1) is disposed opposite the platen 22 on the upstream side of the inkjet head 10 on the conveyance path HK. The conveyance roller 34 is a driven roller supported freely rotatably on the frame of the printing device 1, and is urged toward the surface of the platen 22. The conveyed roll paper R2 is held on the conveyance path HK between the conveyance roller 34 and the conveyor belt 30, and is conveyed in the conveyance direction F in conjunction with movement of the conveyor belt 30. Multiple rollers not shown are also disposed between the head units of the inkjet head 10 to push down on and prevent the conveyed roll paper R2 from separating from the surface of the conveyor belt 30.

Figure 5:
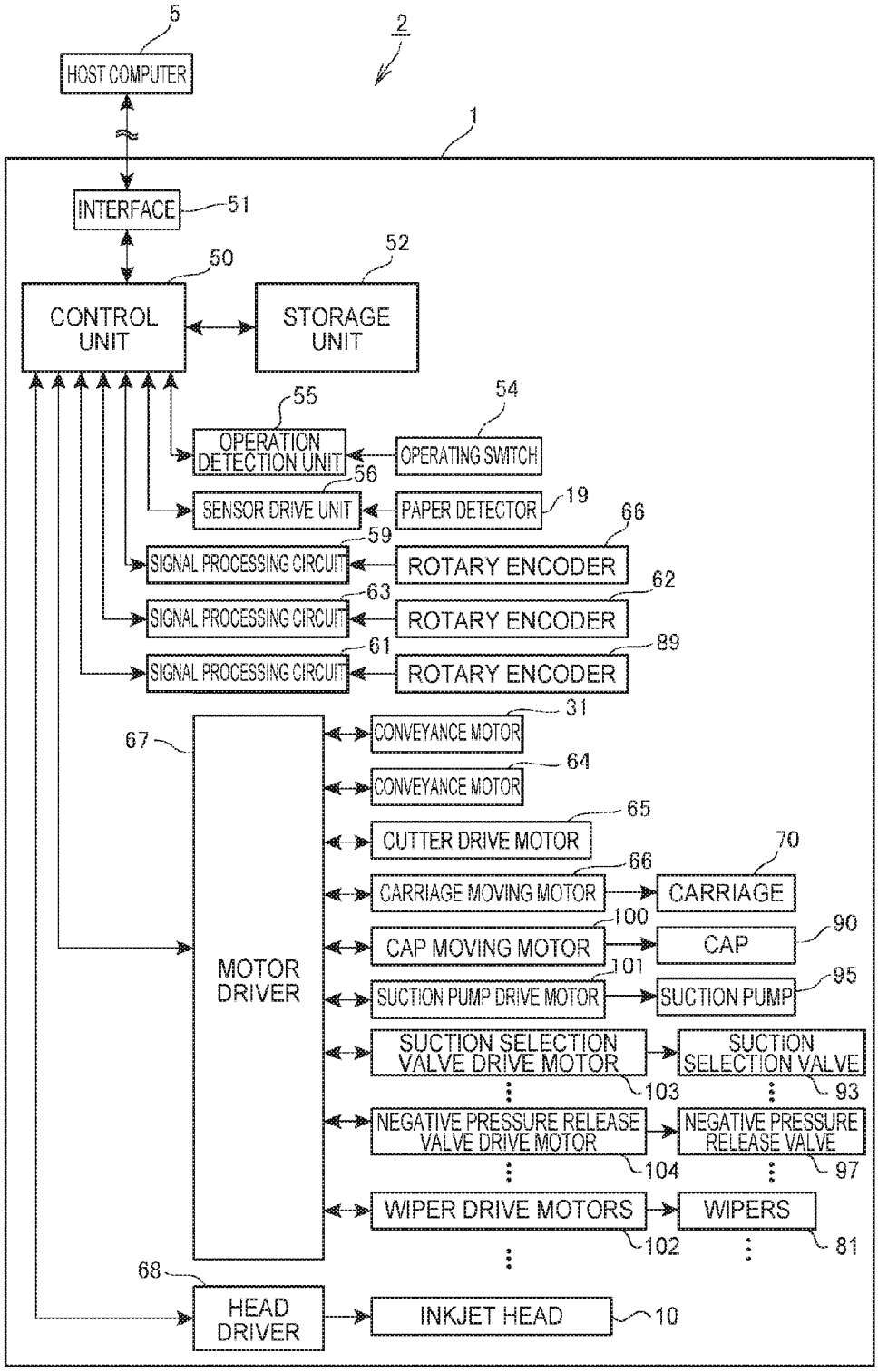
FIG. 5 is a block diagram illustrating the functional configuration of the printing device.

A cutter unit 37 is disposed on the downstream side of the inkjet head 10 on the conveyance path HK. The cutter unit 37 includes a fixed knife and a movable knife on opposite sides of he conveyance path HK, and the movable knife is linked through a gear, for example, to the cutter drive motor 65 (FIG. 5). When the cutter drive motor 65 turns, the movable knife moves to the fixed knife side and cuts the conveyed roll paper R2 therebetween. The cutter unit 37 may make a partial cut across the width leaving the conveyed roll paper R2 uncut in part, or it may cut the conveyed roll paper R2 completely. The printing device 1 cuts the conveyed roll paper R2 to a specific length with the cutter unit 37 after printing by the inkjet head 10, and ejects the cut-off portion from the paper exit.

A winding unit 42 (shown only in FIG. 1) is removably connected to the front of the printing device 1. The winding unit 42 includes a take-up drum 43 onto which the conveyed roll paper R2 discharged from the paper exit is wound, and a drive unit not shown that turns the take-up drum 43. The take-up drum 43 is driven by torque from the conveyance motor 31 of the printing device 1 transferred through a gear train not shown. The take-up drum 43 may be configured to be driven by a motor separate from the conveyance motor 31. The take-up drum 43 turns in the direction indicated by arrow A in the figure, and rewinds the conveyed roll paper R2. When the winding unit 42 is used, the printing device 1 does not cut the conveyed roll paper R2 with the cutter unit 37, and the conveyed roll paper R2 is discharged from the paper exit as a continuous web.

A control board 44 is disposed toward the front on the right side of the paper guide 16. The CPU, RAM, and other peripheral circuits of the control unit 50 described further below are disposed to the control board 44.

As shown in FIG. 1 and FIG. 2, the inkjet head 10 is mounted on a carriage 70. As shown in FIG. 2, the carriage 70 can move in a main scanning direction G1 and a reverse scanning direction G2, and moves the inkjet head 10 between a printing position PP and a home position HP as shown in FIG. 2. The printer control unit 50 (FIG. 4) drives the carriage moving motor 66 to move the carriage 70.

The printing position PP is a position opposite the platen 22, and is the position where ink is ejected to the conveyed roll paper R2 to print an image on the printing surface. To print an image, the inkjet head 10 is moved down by a specific mechanism and set to an appropriate position at the printing position PP.

Figure 4:
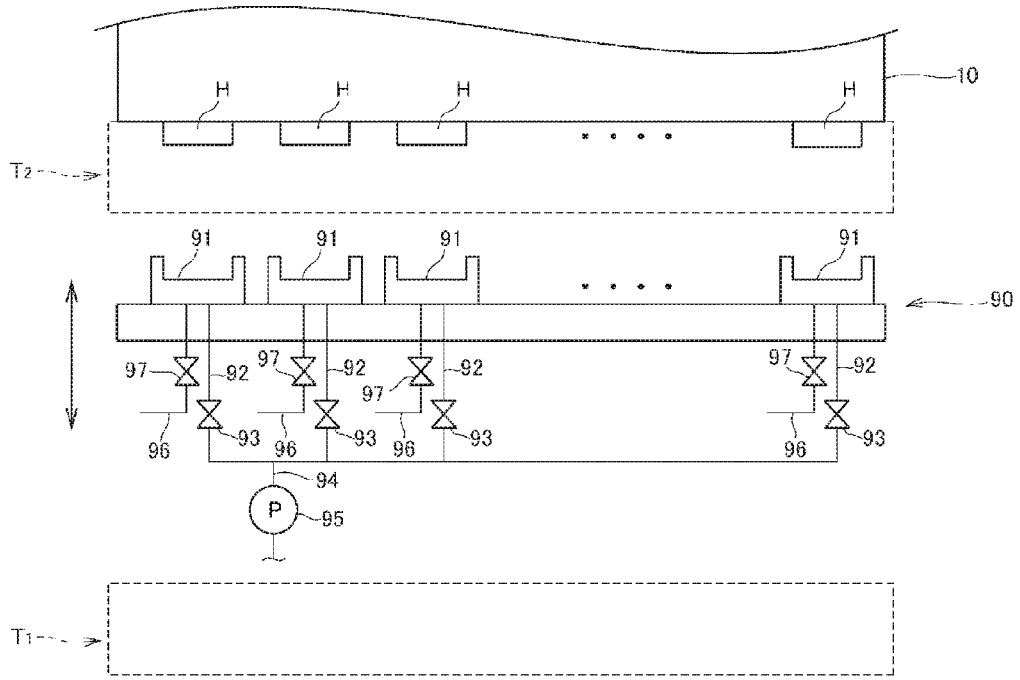
FIG. 4 illustrates the configuration of the inkjet head and cap.

The home position HP is the retracted position of the inkjet head 10 disposed to a position away from the above printing position PP. The printer control unit 50 described below moves the carriage 70 and sets the inkjet head 10 to the home position HP when a specific event occurs, such as when the power is turned off, or when a printing process is not executed for a specific time and the standby mode is entered. The printer control unit 50 then covers the nozzle face of the inkjet head 10 with a cap 90 (FIG. 4). As a result, ink left in the nozzles can be prevented from drying.

Flushing and cleaning processes are also performed at the home position HP.

The flushing operation is an operation performed to suppress an increase in the viscosity of ink left inside the nozzles of the inkjet head 10. During the flushing operation, the printer control unit 50 ejects a specific amount of ink a specific number of times from the nozzles into the cap 90, replacing the ink left inside the nozzles with fresh ink.

Cleaning is described further below.

Figure 3:
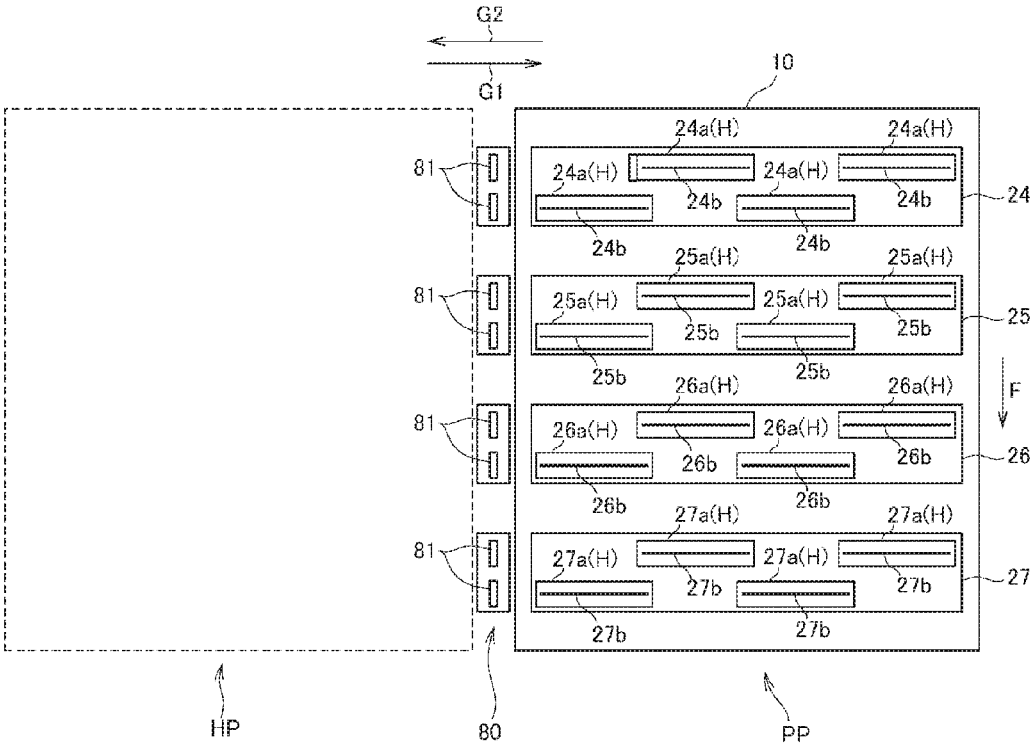
FIG. 3 illustrates the configuration of the inkjet head.

FIG. 3 schematically illustrates the inkjet head 10.

In FIG. 3 the inkjet head 10 is at the printing position PP.

As shown in FIG. 3, the inkjet head 10 has a black head unit 24, cyan head unit 25, magenta head unit 26, and yellow head unit 27. In this embodiment, the head units are arranged in the inkjet head 10 in the order black head unit 24, cyan head unit 25, magenta head unit 26, and yellow head unit 27 in the conveyance direction F.

The four black heads 24*a* (heads) of the black head unit 24 are arranged in a staggered pattern. A black nozzle row 24*b* (nozzle row) is formed in each of the black heads 24*a*. The black nozzle row 24*b* is a row of nozzles (not shown in the figure) that eject ink as fine ink droplets formed in a line crosswise to the conveyance direction F. Ink is supplied by a specific means from a black (K) ink cartridge to the black heads 24*a*. The black heads 24*a* push black (K) ink toward the print medium and eject fine ink droplets from specific nozzles by means of a piezoelectric or other type of actuator. As a result, dots are formed on the print medium.

The four cyan heads 25*a* (heads) of the cyan head unit 25 are likewise formed in a staggered pattern. A cyan nozzle row 25*b* (nozzle row) that ejects droplets of cyan (C) ink from the nozzles is formed in each of the cyan heads 25*a*. The four magenta heads 26*a* (heads) of the magenta head unit 26 are likewise formed in a staggered pattern. A magenta nozzle row 26*b* (nozzle row) that ejects droplets of magenta (M) ink from the nozzles is formed in each of the magenta heads 26*a*. The four yellow heads 27*a* (heads) of the yellow head unit 27 are likewise formed in a staggered pattern. A yellow nozzle row 27*b* (nozzle row) that ejects droplets of yellow (Y) ink from the nozzles is formed in each of the yellow heads 27*a*.

Note that for convenience, each of the heads and the nozzle row in each head are shown in FIG. 3, but the heads are actually formed so that ink is ejected down vertically from the nozzles in each nozzle row, and members to achieve this configuration are provided.

When not specifically differentiating between the black heads 24*a*, cyan heads 25*a*, magenta heads 26*a*, and yellow heads 27*a*, the heads are referred to as simply the heads H. As shown in FIG. 3, the inkjet head 10 has 16 heads H.

As shown in FIG. 3, a wiping unit 80 is disposed between the printing position PP and the home position HP.

The wiping unit 80 has eight wipers 81 disposed to positions passing over the heads H of the head unit of each color when the inkjet head 10 moves from the home position HP to the printing position PP or the opposite direction.

The wipers 81 can move between two positions as controlled by the printer control unit 50, a protruding position extending toward the inkjet head 10, and a stored position retracted in the opposite direction.

The wiping unit 80 is a member that is used for wiping. Wiping is a process of wiping ink and other foreign matter from the nozzle faces of the heads H to remove soiling from the nozzle face of the heads H. The wiping process is described further below.

FIG. 4 illustrates the configuration of the inkjet head 10, and the cap 90 that can cover the inkjet head 10 when in the home position HP.

For brevity, the configuration of the inkjet head 10 and the cap 90 are shown simplified in FIG. 4, and the relative positions of parts in FIG. 4 do not necessarily match the relative positions of the parts in the configurations shown in FIG. 1 to FIG. 3.

The cap 90 can move vertically at the home position HP between a standby position T1 separated from the inkjet head 10, and a capping position T2 covering the inkjet head 10. The printer control unit 50 described further below drives a cap moving motor 100 to move the cap 90 between the standby position T1 and capping position T2.

As described above, the inkjet head 10 has 16 heads H. The cap 90 likewise comprises 16 head caps 91, one for each of the 16 heads H.

Each of the heads H is capped by the corresponding head cap 91 when the cap 90 is at the capping position T2. When the heads H are capped by the head caps 91, the heads H are sealed by the head caps 91.

A suction tube 92, which is a tube through air moves, is connected to each head cap 91. A suction selection valve 93 is also disposed to each suction tube 92. When the suction selection valve 93 is open, air can flow through the connected suction tube 92. When the suction selection valve 93 is closed, the air path through the suction tube 92 is closed.

A single pump connection tube 94 is connected to each of the suction tubes 92. A suction pump 95 is connected to the pump connection tube 94.

A negative pressure release tube 96 through which air can flow is connected to each head cap 91. A negative pressure release valve 97 is disposed to each negative pressure release tube 96.

The cap 90 is a member used for cleaning. Cleaning is an operation that forcibly suctions ink clogs from the nozzles of the inkjet head 10. The cleaning process is described further below.

FIG. 5 is a block diagram illustrating the functional configuration of the printing device 1.

As shown in FIG. 5, the printing device 1 is connected to a host computer 5, and the printing device 1 and host computer 5 together embody a printing system 2.

An application program for controlling the printing device 1 and a printer driver program are installed on the host computer 5, and the host computer 5 sends commands to the printing device 1 and controls the printing device 1 by functions of these programs.

As shown in FIG. 5, the printing device 1 has a control unit 50 that controls other parts of the printing device 1. An interface 51 that connects to the host computer 5, and a printer storage unit 52, are connected to the control unit 50. The interface 51 connects to the host computer 5 by wire or wirelessly.

The control unit 50 includes a CPU as an operating unit, ROM and RAM, not shown in the figures. Firmware that can be executed by the CPU and data related to the firmware is nonvolatilely stored in the ROM of the control unit 50. Data related to the firmware run by the CPU is also temporarily stored in RAM. Other peripheral circuits and devices may also be disposed to the control unit 50. The storage unit 52 nonvolatilely stores programs and data. Control programs run by the control unit 50, data related to the control programs, and commands and data the printing device 1 receives from the host computer 5 are stored in the storage unit 52.

An operation detection unit 55 that detects operation of operating switches 54 disposed to a switch panel (not shown in the figure) is connected to the control unit 50. The operating switches 54 include, for example, a paper feed switch commanding the conveyance operation of the printing device 1, a cut switch commanding operation of the cutter unit 37, and configuration switches for configuring settings.

A sensor drive unit 56 that acquires the detection values output from the paper detector 19 is connected to the control unit 50. The sensor drive unit 56 supplies drive power to the paper detector 19 causing the paper detector 19 to emit as controlled by the control unit 50, acquires the detection voltage the paper detector 19 outputs according to the amount of light detected, and outputs a detection value indicating the detection voltage to the control unit 50.

A signal processing circuit 59 is connected to the control unit 50, and a rotary encoder 60 is connected to the signal processing circuit 59. The rotary encoder 60 is a rotary encoder that is used to detect the conveyance direction and conveyance speed of the print medium. The signal processing circuit 59 applies a specific signal process to the detection value from the rotary encoder 60, and outputs to the control unit 50. The control unit 50 together with an encoder counter not shown detects the conveyance direction and conveyance speed of the print medium based on the input value from the signal processing circuit 59.

A signal processing circuit 63 is also connected to the control unit 50, and a rotary encoder 62 is connected to this signal processing circuit 63. The rotary encoder 62 is a rotary encoder used to detect the rotational angle of the tension lever 13. The signal processing circuit 63 applies a specific signal process to the detection value from the rotary encoder 62, and outputs to the control unit 50. The control unit 50 together with an encoder counter not shown detects the rotational angle of the tension lever 13 based on the input value from the signal processing circuit 63.

The other rotary encoder 89 and signal processing circuit 61 are described further below.

As shown in FIG. 5, a motor driver 67 that drives the conveyance motor 31, conveyance motor 64, cutter drive motor 65, carriage moving motor 66, cap moving motor 100, suction pump drive motor 101, eight wiper drive motors 102, sixteen suction selection valve drive motors 103, and sixteen negative pressure release valve drive motors 104 is also connected to the control unit 50.

As described above, the conveyance motor 31 is a motor that conveys the print medium by causing the conveyor belt 30 to move. The conveyance motor 31 is a brushless DC motor. The control unit 50 controls the motor driver 67 and supplies drive current from the motor driver 67 to the conveyance motor 31 to drive the conveyance motor 31.

As described above, the conveyance motor 64 is a motor that causes the paper roll R1 to turn by rotating the roll paper spindle 9 inserted to the core R3 of the paper roll R1. When the paper roll R1 turns in the direction shown as the conveyance direction F, the conveyed roll paper R2 is pulled from the paper roll R1. When the paper roll R1 turns in the opposite direction as the conveyance direction F, the conveyed roll paper R2 is pulled back to the paper roll R1. The conveyance motor 64 is also a brushless DC motor. The control unit 50 controls the motor driver 67 to supply drive current from the motor driver 67 to the conveyance motor 64, and drive the conveyance motor 64.

The cutter drive motor 65 is a motor that drives the movable knife of the cutter unit 37 to cut the print medium. The carriage moving motor 66 is a motor that moves the carriage 70 (inkjet head 10) between the printing position PP and the home position HP. The cap moving motor 100 is a motor that moves the cap 90 between the standby position T1 and the capping position T2 described above. The suction pump drive motor 101 is a motor that drives the suction pump 95.

The suction selection valve drive motors 103 are motors that set the suction selection valves 93 to the open position or the closed position. As described above, there are sixteen suction selection valves 93 corresponding to the head caps 91. There are also sixteen suction selection valve drive motors 103 corresponding to the suction selection valves 93.

The negative pressure release valve drive motors 104 are motors that set the negative pressure release valves 97 to the open position or the closed position as controlled by the control unit 50. As described above, there are sixteen negative pressure release valves 97 corresponding to the head caps 91. There are also sixteen negative pressure release valve drive motors 104 corresponding to the negative pressure release valves 97.

The wiper drive motors 102 are motors that move the wipers 81 as controlled by the control unit 50, and set the wipers 81 to the protruding position or the stored position. As described above, there are eight wipers 81. There are therefore eight wiper drive motors 102, one for each wipers 81.

A head driver 68 that drives the inkjet head 10 is also connected to the control unit 50. The control unit 50 controls the head driver 68 to supply voltage to and operate the pumps (not shown in the figure) that supply ink from the ink tanks (not shown in the figure) to the inkjet head 10, and the piezoactuators (not shown in the figure) disposed to the heads H of the inkjet head 10. As a result, ink droplets are ejected from the nozzles of the heads H and dots are formed.

While conveying the print medium in conjunction with printing images on the print medium, the control unit 50 detects the position of the print medium on the conveyance path HK based on the detection value from the paper detector 19 and the detection values from other sensors. The control unit 50 also monitors the conveyance speed of the print medium based on the detection value from the rotary encoder 60. The control unit 50 also monitors if the conveyance speed of the print medium is appropriate and adjusts the conveyance speed based on the rotational angle of the tension lever 13 detected from the detection value of the rotary encoder 62.

The printing device 1 according to this embodiment of the invention can also run a nozzle check that detects if there are any missing nozzles in any of the heads H. A missing nozzle means that ink droplets are not ejected normally from a nozzle because there is an ink clog in the nozzle, the ink in the nozzle is dry, the nozzle is dirty, or other reason.

The nozzle check process is run when, for example, the printer power turns on, the printer is reset, before printing starts, or when commanded by the user.

The following method may be used to perform the nozzle check process.

For example, the printing device 1 may have a nozzle check mechanism. This nozzle check mechanism has an electrode that charges the ink droplets ejected from a nozzle. The nozzle check mechanism also has a conductive member on which the charged ink droplets ejected from the nozzle land. The electrical signals flowing through the conductive member are output to a specific signal processing circuit. In the configuration described above, the control unit 50 causes a specific volume of ink droplets to be ejected from the target nozzles being checked to detect missing nozzles. The ejected ink droplets land on the conductive member after being specifically charged by the electrode. When the ink droplets land, the current flow through the conductive member changes, and a signal representing this change is output to the control unit 50 through a specific signal processing circuit. When the value indicated by the input signal exceeds a specific threshold, the control unit 50 determines that the expected amount of ink was ejected normally and that nozzle is not missing when printing. However, if the value indicated by the input signal is less than the specific threshold, the control unit 50 determines that the expected amount of ink was not ejected normally for some reason, and that nozzle is missing. The control unit 50 thus checks all of the nozzles to determine if there any missing nozzles by the method described above, and if missing nozzles are found, identifies the head H with missing nozzles.

Note that the nozzle check process is not limited to the foregoing. For example, ink may be ejected from the target nozzles onto the print medium to form dots, and the printed dots then read optically to determine if there are any missing nozzles. Further alternatively, the signal waveform of the control signals that drive the actuators, for example, may be monitored to determine if there are any missing nozzles. More specifically, the nozzle check may be run using any method that can check each nozzle and detect any missing nozzles.

If a particular nozzle is found to be missing, the missing nozzle can be eliminated by running the cleaning process on the head H having the missing nozzle. As a result, the printing device 1 according to this embodiment executes a cleaning process to eliminate the missing nozzle when a nozzle is determined to be missing as a result of the nozzle check process.

The printing device 1 according to this embodiment can run the cleaning process using either a first cleaning method or a second cleaning method.

The printing device 1 also cannot print on the print medium during the cleaning process. As a result, the printing device 1 according to this embodiment shortens the time required for cleaning by changing the cleaning method appropriately.

The operation of the printing device 1 in the first cleaning method and the second cleaning method are described first below, and a process for changing the cleaning method is then described.

Figure 6:
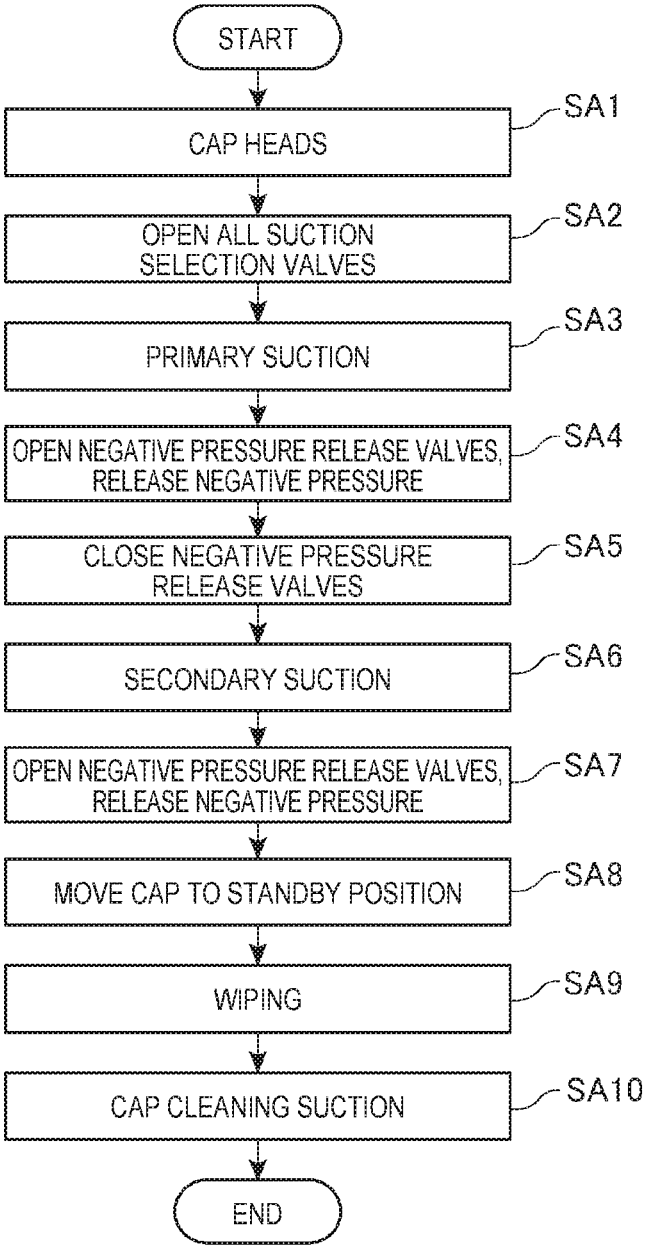
FIG. 6 is a flow chart of the operation of the printing device.

FIG. 6 is a flow chart showing the operation of the printing device 1 when cleaning by the first cleaning method.

When the process shown in FIG. 6 described below starts, the inkjet head 10 is at the home position HP. All suction selection valves 93 and all negative pressure release valves 97 are also closed.

The first cleaning method is a cleaning method that suctions ink from all 16 heads H of the inkjet head 10 at one time. Because ink is suctioned from all heads H, ink is necessarily suctioned from any missing nozzles, and missing nozzles can be eliminated.

As shown in FIG. 6, after starting cleaning using the first cleaning method, the control unit 50 of the printing device 1 moves the cap 90 to the capping position T2 and caps each of the 16 heads H with the corresponding head cap 91 (step SA1).

Next, the control unit 50 opens all suction selection valves 93 (step SA2).

Next, the control unit 50 drives the suction pump 95 by driving the suction pump drive motor 101 at a specific speed K1 to suction ink from the nozzles of all heads H (referred to below as "primary suction") (step SA3). More specifically, because all suction selection valves 93 are open, negative pressure is produced inside the head caps 91 by driving the suction pump 95, and ink inside the nozzles of each head H is suctioned therefrom by the negative pressure.

The objective of primary suction in step SA3 is to forcibly suction ink from all of the nozzles. The speed K1 is therefore set based on the results of prior simulations or tests to a speed that produces sufficient negative pressure in each head cap 91 to forcibly suction ink from all of the nozzles.

Note that a rotary encoder is disposed to the drive shaft of the suction pump drive motor 101 or other rotating body that turns in conjunction with driving the motor. The control unit 50 manages the speed of the suction pump drive motor 101 based on the output value of the rotary encoder during the primary suction operation of step SA3.

Next, the control unit 50 opens all negative pressure release valves 97 (step SA4). When open, the negative pressure release valves 97 enables air to flow through the negative pressure release tubes 96, and when closed cuts off the flow of air through the negative pressure release tubes 96. By opening all suction selection valves 93 in step SA4, air flows into the head cap 91, relieving the negative pressure inside the head cap 91.

Next, the control unit 50 closes the negative pressure release tubes 96 (step SA5).

Next, the control unit 50 drives the suction pump 95 by driving the suction pump drive motor 101 at a specific speed K2 to suction ink from the nozzles of all heads H (referred to below as "secondary suction") (step SA6). More specifically, because all suction selection valves 93 are open, negative pressure is produced inside the head caps 91 by driving the suction pump 95, and ink inside the nozzles of each head H is suctioned therefrom by the negative pressure.

The objective of secondary suction in step SA6 is to remove soiling of the nozzle faces of the heads H caused by primary suction in step SA3. Speed K2 is therefore slower than speed K1 (set to a lower value), and is set, for example, to a speed enabling suctioning ink soiling the nozzle faces of all heads H.

Next, the control unit 50 closes all negative pressure release valves 97 (step SA7). This releases the negative pressure in the head caps 91.

Next, the control unit 50 controls the cap moving motor 100 to move the cap 90 to the standby position T1 (step SA8).

Next, the control unit 50 executes the wiping process (step SA9).

The wiping process is a process that removes soiling of the nozzle faces by wiping the nozzle faces of the heads H with the wipers 81 to remove ink from the nozzle face. The process of wiping soiling from the nozzle face of one head H with a wiper 81 is referred to below as wiping.

More specifically, to wipe any one head H, the control unit 50 described below sets the corresponding wiper 81 to the protruding position. Next, the control unit 50 moves the inkjet head 10 so that the head H to be wiped passes over the wiper 81 at the protruding position. When the head H passes over the wiper 81, the wiper 81 moves relative to the head H in contact with the nozzle face of the head H as the head H moves. As a result, ink on the nozzle face is wiped off by the wiper 81. A mechanism for recovering the ink wiped off by the wiper 81 is also disposed to a position relative to the wipers 81.

In the wiping process of step SA8, all heads H, that is, all 16 heads H, are wiped once in a specific order. This is for the following reason. Specifically, this is because in a configuration that wipes plural heads H simultaneously, the relative positions of the heads H and wipers 81 must be precisely adjusted to reliably wipe the plural heads H with the plural wipers 81, and this can increase the cost of production.

Next, the control unit 50 executes a cap cleaning suction process (step SA10).

The cap cleaning suction process is a process for suctioning ink from the head caps 91 to remove any ink in the head caps 91 by applying suction by the suction pump 95 when the cap 90 is not at the capping position T2.

In step SA10, the control unit 50 drives the suction pump 95 after opening all suction selection valves 93. Any ink left in the head caps 91 is therefore suctioned from the caps.

As described above, ink is suctioned from all heads H in the first cleaning method. Ink is therefore reliably suctioned from the nozzles that are detected as missing nozzles. However, ink is also suctioned from the nozzles that are printing normally.

The first cleaning method thus involves in sequence one primary suction operation, one secondary suction operation, sixteen wiping operations, and one cap cleaning suction operation. The time required for cleaning by the first cleaning method is time J1. This time J1 is determined based on the results of prior simulations or tests.

Next is a flow chart showing the operation of the printing device 1 when cleaning by the second cleaning method.

The second cleaning method is a cleaning method that suctions ink from the heads H where missing nozzles are detected.

When the process shown in FIG. 7 described below starts, the inkjet head 10 is at the home position HP. All suction selection valves 93 and all negative pressure release valves 97 are also closed.

One or more nozzles were also detected as missing nozzles as the result of a prior nozzle check.

Note also that a head H having a nozzle that is detected as a missing nozzle is referred to below as a "missing nozzle head."

Figure 7:
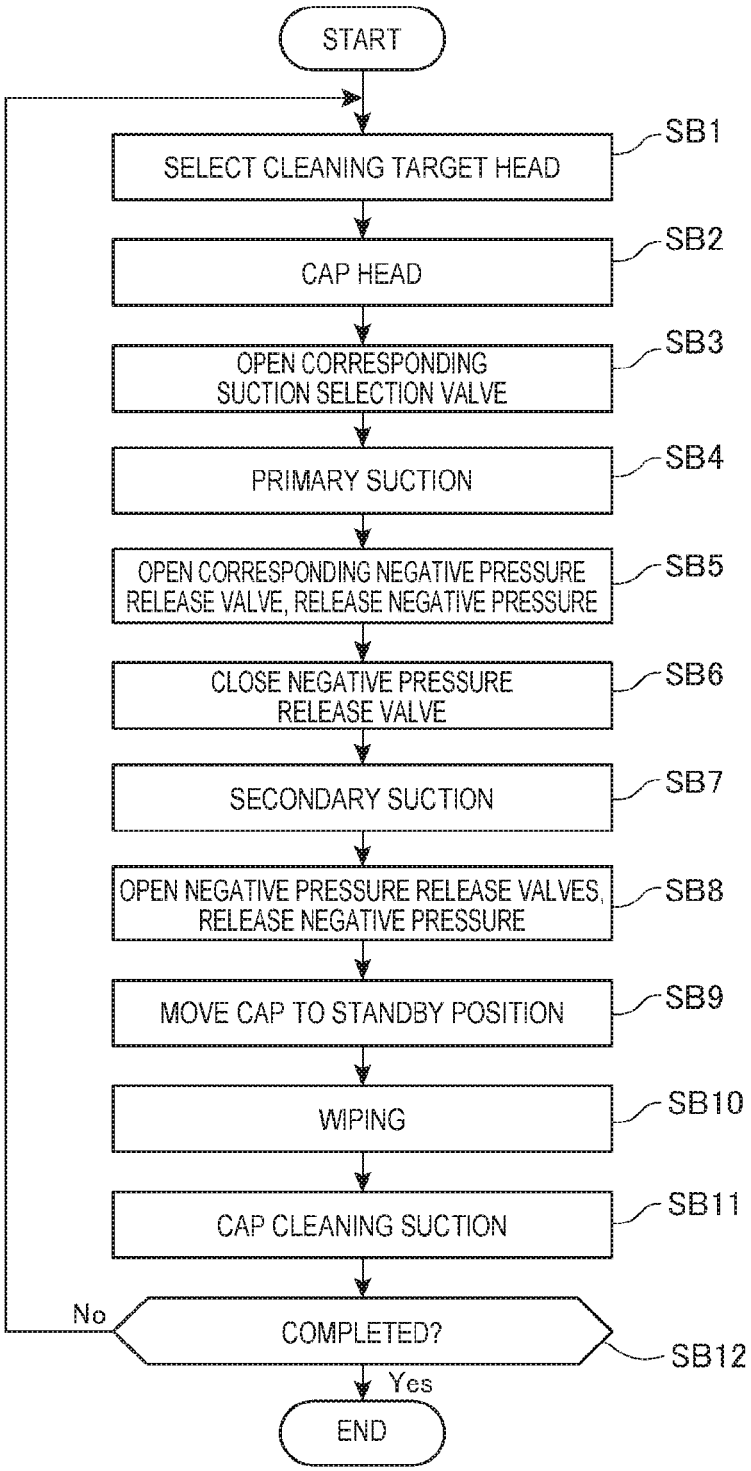
FIG. 7 is a flow chart of the operation of the printing device.

As shown in FIG. 7, the control unit 50 selects one of the missing nozzle heads as the head H to clean (step SB1). The selected head H is the head processed by the process of step SB2 to step SB11 described below. The head H selected in step SB1 is referred to below as the cleaning target head. In the second cleaning method the missing nozzle heads are selected for cleaning as the cleaning target head one at a time.

Next, the control unit 50 moves the cap 90 to the capping position T2 and caps the head with the corresponding head cap 91 (step SB2).

Next, the control unit 50 opens the suction selection valve 93 connected to the head cap 91 capping the cleaning target head (step SB3).

Next, the control unit 50 drives the suction pump 95 by driving the suction pump drive motor 101 at a specific speed K3 to apply primary suction to the nozzles of the cleaning target head (step SB4). At the time of step SB4, the suction selection valve 93 of the cleaning target head is open, and the other suction selection valves 93 are closed. As a result, the cleaning target head is suctioned by driving the suction pump 95.

The objective of primary suction in step SB4 is to forcibly suction ink from the nozzles of the cleaning target head by applying a strong suction force. The suction target of the primary suction in the first cleaning method (step SA3) is all (16) heads H. The suction target of primary suction in the second cleaning method (step SB4) is a single head H. As a result, the speed K3 used for primary suction in the second cleaning method is slower (a lower value) than the speed K1 used for primary suction in the first cleaning method. In addition, the value of this speed K3 is set so that negative pressure sufficient to forcibly suction ink from the nozzles of the one head H is produced inside the corresponding single head cap 91.

Next, the control unit 50 opens the negative pressure release valve 97 of the head cap 91 capping the cleaning target head (step SB5). As a result, the negative pressure inside the head cap 91 is released.

Next, the control unit 50 closes the negative pressure release tube 96 of the head cap 91 capping the cleaning target head (step SB6).

Next, the control unit 50 drives the suction pump 95 by driving the suction pump drive motor 101 at a specific speed K4 to apply secondary suction to the nozzles of the cleaning target head (step SB7).

The objective of secondary suction in step SB7 is to remove soiling of the nozzle face of the cleaning target head caused by primary suction in step SB4. Speed K4 is therefore slower than speed K3, and is set, for example, to a speed enabling suctioning ink soiling the nozzle face of the cleaning target head.

Next, the control unit 50 opens the negative pressure release valve 97 of the head cap 91 capping the cleaning target head (step SB8). As a result, the negative pressure inside the head cap 91 is released.

Next, the control unit 50 controls the cap moving motor 100 to move the cap 90 to the standby position T1 (step SB9).

Next, the control unit 50 wipes the cleaning target head (step SB10).

Next, the control unit 50 applies the cap cleaning suction process to the head cap 91 that capped the cleaning target head (step SB11). As a result, any ink left in the head cap 91 is suctioned out.

Next, the control unit 50 determines if cleaning has been completed for all of the missing nozzle heads (step SB12). If cleaning all missing nozzle head is not completed (step SB12 returns NO), the control unit 50 returns to step SB1. If cleaning all missing nozzle heads is completed (step SB12 returns YES), the control unit 50 ends the process.

As described above, ink is suctioned from each of the missing nozzle heads by the second cleaning method. Ink is therefore reliably suctioned from the nozzles that are detected as missing nozzles. Ink consumption is also suppressed because ink is not suctioned from heads H with no missing nozzles.

The second cleaning method thus involves running a process Q including one primary suction operation, one secondary suction operation, one wiping operation, and one cap cleaning suction operation the same number of times as there are missing nozzle heads. The time required to run process Q is time J2. This time J2 is determined based on the results of prior simulations or tests. The time required for cleaning when cleaning is done with the second cleaning method is therefore time J2 times N (where N is the number of missing nozzle heads).

In other words, the time required for cleaning when cleaning with the second cleaning method changes according to the number of missing nozzle heads.

The reason why ink is not suctioned simultaneously from plural heads H (missing nozzle heads) in the second cleaning method is described next. More specifically, in order to apply the primary suction and secondary suction operations appropriately according to their respective purposes, the speed of the suction pump drive motor 101 must be adjusted according to the number of heads H from which to suction ink and the relative positions of the heads H from which to suction ink. However, the configuration of this embodiment makes processing difficult and makes programming difficult because of the number of possible combinations of heads H requiring processing.

The printing device 1 according to this embodiment runs a nozzle check process at the appropriate timing and executes the cleaning process based on the result of the nozzle check. To execute the cleaning process, the printing device 1 appropriately selects the first cleaning method or the second cleaning method as the cleaning method to shorten the time required for cleaning.

Operation of the printing device 1 after executing the nozzle check process is described below.

Figure 8:
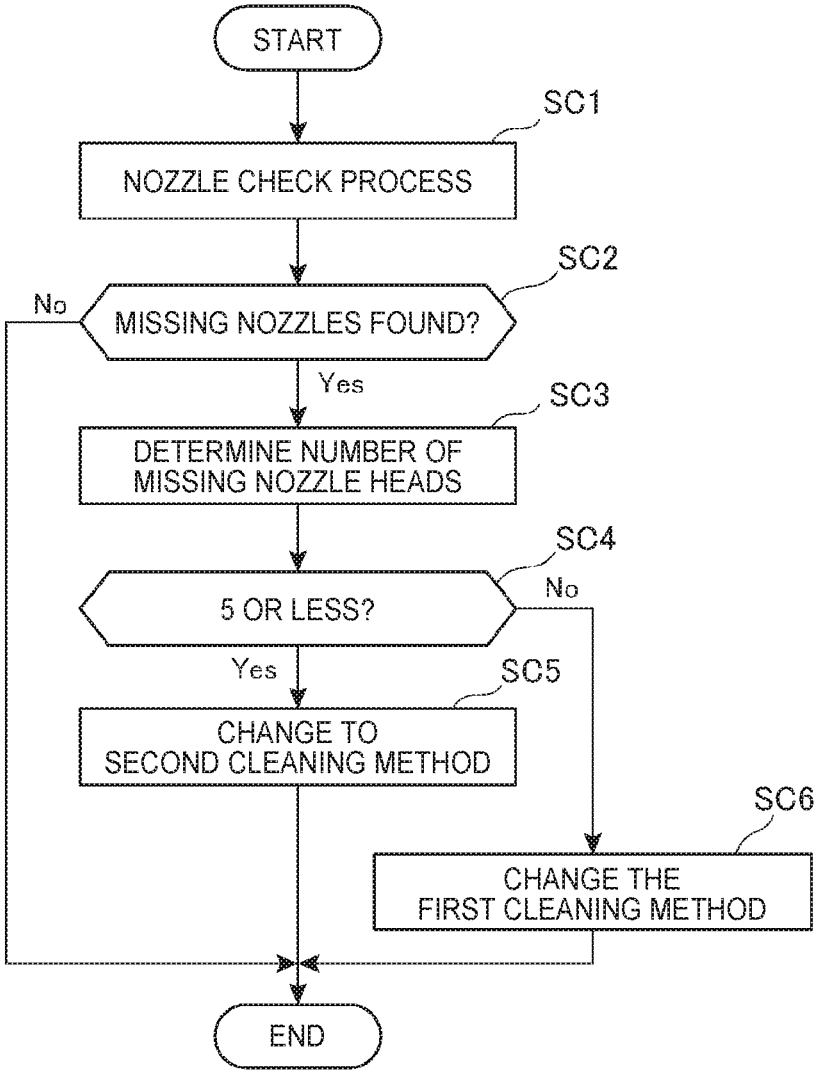
FIG. 8 is a flow chart of the operation of the printing device.

FIG. 8 is a flow chart showing the operation of the printing device 1 after the nozzle check process.

As shown in FIG. 8, the control unit 50 executes the nozzle check process at specific times (step SC1).

Next, the control unit 50 determines if any nozzle was detected as a missing nozzle by the nozzle check (step SC2). If a missing nozzle is not detected (step SC2 returns NO), the control unit 50 ends the process. However, if any nozzle is detected as a missing nozzle (step SC2 returns YES), the control unit 50 determines the number of heads H with a missing nozzle (missing nozzle heads) (step SC3).

As described above, the time required for cleaning by the first cleaning method is time J1. The time required for cleaning by the second cleaning method is time J2 times N (where N is the number of missing nozzle heads).

That (time J1)>(time J2×N) if N<=5, and (time J1)<(time J2×N) if N>=6, is known in advance in this embodiment of the invention. More specifically, if the number of missing nozzle heads is 5 or less, cleaning with the second cleaning method requires less time than cleaning with the first cleaning method. However, if the number of missing nozzle heads is 6 or more, cleaning with the first cleaning method requires less time than cleaning with the second cleaning method.

As a result, the control unit 50 determines in step SC4 if the number of missing nozzle heads is five or less. If five or less, the control unit 50 sets the cleaning method to the second cleaning method (step SC5). However, if 6 or more, the control unit 50 sets the cleaning method to the first cleaning method (step SC6).

This process results in cleaning being done with the method that requires less time for cleaning.

As described above, a printing device according to this embodiment can execute a cleaning process using either a first cleaning method that suctions ink from plural (in this embodiment, all) heads H comprising the inkjet head 10, or a second cleaning method that suctions ink from plural heads H of the inkjet head 10 one at a time. The control unit 50 also switches between (selects one of) the first cleaning method and second cleaning method as the method of cleaning the inkjet head 10.

Thus comprised, cleaning can be done using either a first cleaning method or a second cleaning method. The cleaning method can also be changed according to the condition of the heads to the method that requires less time for cleaning, and the time required for cleaning can therefore be shortened.

When cleaning with the second cleaning method, this embodiment suctions ink from the heads H in which missing nozzles are detected. To clean the inkjet head 10, the control unit 50 detects if there are any missing nozzles in the heads H, and changes the method of cleaning to the whichever of the first cleaning method and the second cleaning method requires less time for cleaning.

Thus comprised, because the time required for cleaning with the second cleaning method differs according to the number of heads H in which missing nozzles are detected, the method of cleaning can be changed to the method that requires less time for cleaning.

When cleaning the inkjet head 10 in this embodiment, the control unit 50 changes the method of cleaning to the method that requires less time for cleaning including wiping after ink suction.

Thus comprised, the method of cleaning can be changed so that the time required for cleaning including the time required for wiping is shorter.

In the first cleaning method in this embodiment of the invention, ink is suctioned simultaneously from all heads H of the inkjet head 10, and the heads H are then wiped one by one. In the second cleaning method, the heads H targeted for ink suction are cleaned one at a time by ink suction and then wiped. The control unit 50 can thus change the method used to clean the inkjet head 10 to the method that requires less time for cleaning including wiping.

Thus comprised, the method of cleaning can be changed to reflect the time required for wiping so that the time required for cleaning is shorter.

The invention is described above with reference to a preferred embodiment thereof, but the invention is not limited thereto and can be modified and adapted in many ways without departing from the scope of the accompanying claims.

For example, time J1 and time J2 are constants in the embodiment described above, but time J1 and time J2 may be changed to reflect factors that may affect the processing time, such as the ambient temperature and the head temperature.

The time required for cleaning with the second cleaning method is calculated as time J2×N in the above example. However, depending upon the number and relative positions of the missing nozzle heads, this time may be a value other than time J2×N. As a result, configurations that also consider the locations and number of missing nozzle heads to determine the time required for cleaning in the second cleaning method are also conceivable.

A specific margin of error may also be used when comparing the time required by the first cleaning method and the time required by the second cleaning method.

The function blocks shown in FIG. 5 can also be embodied as desired by the cooperation of hardware and software, and do not suggest a specific hardware configuration. The functions of the printing device 1 may also be embodied by other devices externally connected to the printing device. The printing device 1 may also execute the processes described above by running a program stored on an externally connected storage medium.

INDUSTRIAL APPLICABILITY

As described above, the present invention is useful for head cleaning in a printing device with an inkjet head having a plurality of heads with a row of nozzles, and is particularly suited to shortening the time required for cleaning based on the condition of the heads.

The invention claimed is:

1. A control method of a printing device having an inkjet head including plural heads with a nozzle row, and configured to clean the inkjet head by either a first cleaning method suctioning ink from the plural heads of the inkjet head simultaneously, or a second cleaning method separately suctioning ink from plural heads of the inkjet head separately, comprising:

detecting missing nozzles in each head of the heads when cleaning the inkjet head;

determining, based on a number of missing nozzle heads that include a missing nozzle according to the detecting, whether cleaning by the first cleaning method or cleaning by the second cleaning method requires less time; and performing the cleaning by the determining method that requires less cleaning time.

2. The control method of a printing device described in claim 1, wherein:

the second cleaning method suctions ink one by one from a plurality of missing nozzle heads.

3. The control method of a printing device described in claim 1, wherein:

the time required for cleaning including wiping after suctioning ink is selected to clean the inkjet head.

4. The control method of a printing device described in claim 3, wherein:

in the first cleaning method, the heads are wiped sequentially after simultaneously suctioning ink from all heads in the inkjet head;

in the second cleaning method, the heads suctioned are wiped one by one.

5. A control method of a printing device including a plurality of heads, wherein each of the plurality of heads including a plurality of nozzles, comprising:

detecting whether any of the plurality of nozzles of the heads is a missing nozzle;

acquiring a number of a missing nozzle heads including at least a missing nozzle based on the detecting;

selecting a cleaning method from a first cleaning method and a second cleaning method, based on the number of the missing nozzle heads, the cleaning method includes the ink suctioning step; and performing the selected cleaning method as cleaning the inkjet head; wherein the first cleaning method includes suctioning ink from the plurality of heads simultaneously as the ink suctioning step, and the second cleaning method includes suctioning ink from the missing nozzle head separately as the ink suctioning step.

6. The control method described in claim 5, further comprising:

calculating a first required time for performing the first cleaning method and a second required time for performing the second cleaning method based on the number of the missing nozzles; and comparing the calculated first required time and the calculated second required time, wherein when the first required time is less than the second required time, the first cleaning method is selected, and when the second required time is less than the first required time, the second cleaning method is selected.

7. The control method described in claim 6, wherein:

the cleaning method including wiping after performing the ink suctioning step.

8. The control method described in claim 7, wherein:

when the first cleaning method is selected, the plurality of heads are wiped in the wiping, and when the second cleaning method is selected, the missing nozzle head is wiped in the wiping.

* * * * *